US007061169B1

(12) United States Patent
Fung

(10) Patent No.: US 7,061,169 B1
(45) Date of Patent: Jun. 13, 2006

(54) IMPACT AND CORROSION RESISTANT LAMP HOLDER

(76) Inventor: Duncan C. Fung, 611 Walsing Dr., Richmond, VA (US) 23229

( * ) Notice: Subject to any disclaimer, the term of this patent is extended or adjusted under 35 U.S.C. 154(b) by 154 days.

(21) Appl. No.: 10/830,369

(22) Filed: Apr. 22, 2004

(51) Int. Cl.
*H01J 5/48* (2006.01)
*H01J 17/18* (2006.01)
*H01J 61/36* (2006.01)

(52) U.S. Cl. ..... 313/318.01; 313/318.06; 313/318.12; 313/623

(58) Field of Classification Search ..... 313/318.01, 313/318.06, 318.1, 318.12, 623–625
See application file for complete search history.

(56) References Cited

U.S. PATENT DOCUMENTS 5,386,356 A * 1/1995 Davis et al. ..... 362/267
2003/0021114 A1* 1/2003 Moon et al. ..... 362/235
2003/0218877 A1* 11/2003 Moon ..... 362/225
2004/0023540 A1* 2/2004 Schadhauser ..... 439/236
2004/0047149 A1* 3/2004 Amano et al. ..... 362/225

* cited by examiner

*Primary Examiner*—Joseph Williams
*Assistant Examiner*—Bumsuk Won

(57) ABSTRACT

An impact and corrosion resistant lamp holder having a lamp housing formed of electrically non-conductive elastomer. The lamp housing includes a lamp receiving portion and external electrical contacts. A first electrically conductive pathway is provided leading from the lamp receiving portion to a first of the electrical contacts. A second electrically conductive pathway is provided leading from the lamp receiving portion to a second of the electrical contacts. The first and the second electrically conductive pathways are formed of electrically conductive elastomer and electrically conductive metal. The lamp housing eliminates any metal to metal contact between the lamp housing and its inserted lamp, thereby significantly reducing transmittance of vibrations to the lamp.

6 Claims, 7 Drawing Sheets

IMPACT AND CORROSION RESISTANT LAMP HOLDER

FIELD OF THE INVENTION

The present invention relates to a lamp holder and particularly to a lamp holder constructed of elastomeric materials for enhanced impact resistance and improved corrosion resistance.

BACKGROUND OF THE INVENTION

Lamp holders are commonly used in applications in which they are subject to vibrations or impacts, such as in motor vehicles, airplanes, or industrial areas subject to vibrations from heavy machinery. For these applications, it is desirable to provide a lamp holder that is resistant to vibrations or impacts.

Frequently, lamp holders are also used in corrosive applications, such as in marine environments. It is desirable in these applications to provide a lamp holder that is highly resistant to the effects of marine or other corrosive environments.

Conventional lamp holders typically include an insulating shell of plastic or ceramic and a socket adapted to accept a lamp. The plastic and ceramic sockets are typically rigid materials that are very adept at transferring vibrations and shocks to the attached lamp. When subjected to continued vibration or sudden or repeated shocks, the lamps are prone to loosening from the lamp holder. This is a problem common to most lamp holders and their complementary lamps, and may include screw-type sockets, bayonet-type bulbs and holders, lamps having prongs, or simple push-in type lamps and their associated holders. All of these common lamp holders are subject to failure under conditions of vibration or shock.

Although several attempts have been made to provide lamps that are resistant to vibrations and impacts, the lamp holder remains subject to failure from shock and vibration. For example, Sutter, in U.S. Pat. No. 4,112,485, has disclosed a lamp comprising one or more light sources encapsulated in a relatively soft impact absorbing transparent material, which is in turn encapsulated in a relatively hard impact resistant material, such as acrylic or glass.

Sica, U.S. Pat. No. 5,536,998 is directed to a protective assembly for a standard fluorescent lamp. The assembly includes a protective tube preformed from a semi-rigid, transparent material that is received over a glass tube. The inner surface of the protective tube is uniformly spaced apart from the outer surface of the glass tube to form an air space for insulation of the lamp. The desired uniform spacing between the lamp tube and the protective tube is established by a spacer ring located adjacent each end of the glass tube and adhesively bonded to the glass tube. Each spacer ring is formed of a band of semi-rigid polymeric foam strip material. The protective tube and air gap provide protection to the glass tube with the protective tube absorbing impacts and minimizing the possibility of the lamp being broken.

Bedford, et al, U.S. Pat. No. 5,676,459 discloses a door-mounted vibration-tolerant lamp assembly comprising a door-mounting brace for mounting the lamp assembly to an exterior surface of a door. The lamp assembly includes an elastic mount having a mounting bracket and at least one resilient pad disposed between the mounting bracket of the elastic mount and a mounting bracket attached to the door mounting brace such that the resilient pad absorbs a substantial amount of the vibration that is generated when the door is moved to a closed position.

Although various devices are described in the prior art for minimizing the effects of vibration and shock to electric lamps, they do not address the effects of vibration and shock upon the lamp holders. Additionally, enclosing the lamps within multiple tubes increases the cost of the lamps and necessitates the use of a specialized lamp in environments subject to vibration or shock.

Furthermore, the prior art does not address the problems presented by the use of metal conductors in a corrosive environment, which can cause fusion or "locking up" of separate metal components that are in contact with one another.

What is needed therefore is an impact resistant, vibration resistant, and corrosion resistant lamp holder that is capable of protecting a common light bulb. The lamp holder should be capable of protecting various common light sources, such as incandescent, fluorescent, or halogen bulbs. The lamp holder should also be capable of accommodating various bulb connection arrangements, such as screw-in, bayonet, prongs, or push-in type arrangements.

SUMMARY OF THE INVENTION

According to the present invention, there is provided an impact and corrosion resistant lamp holder having a lamp housing formed of electrically non-conductive elastomer. The lamp housing includes a lamp receiving portion and external electrical contacts. A first electrically conductive pathway is provided leading from the lamp receiving portion to a first of the electrical contacts. A second electrically conductive pathway is provided leading from the lamp receiving portion to a second of the electrical contacts. The first and the second electrically conductive pathways are formed of electrically conductive elastomer and electrically conductive metal.

TABLE OF NOMENCLATURE

Figure 1:
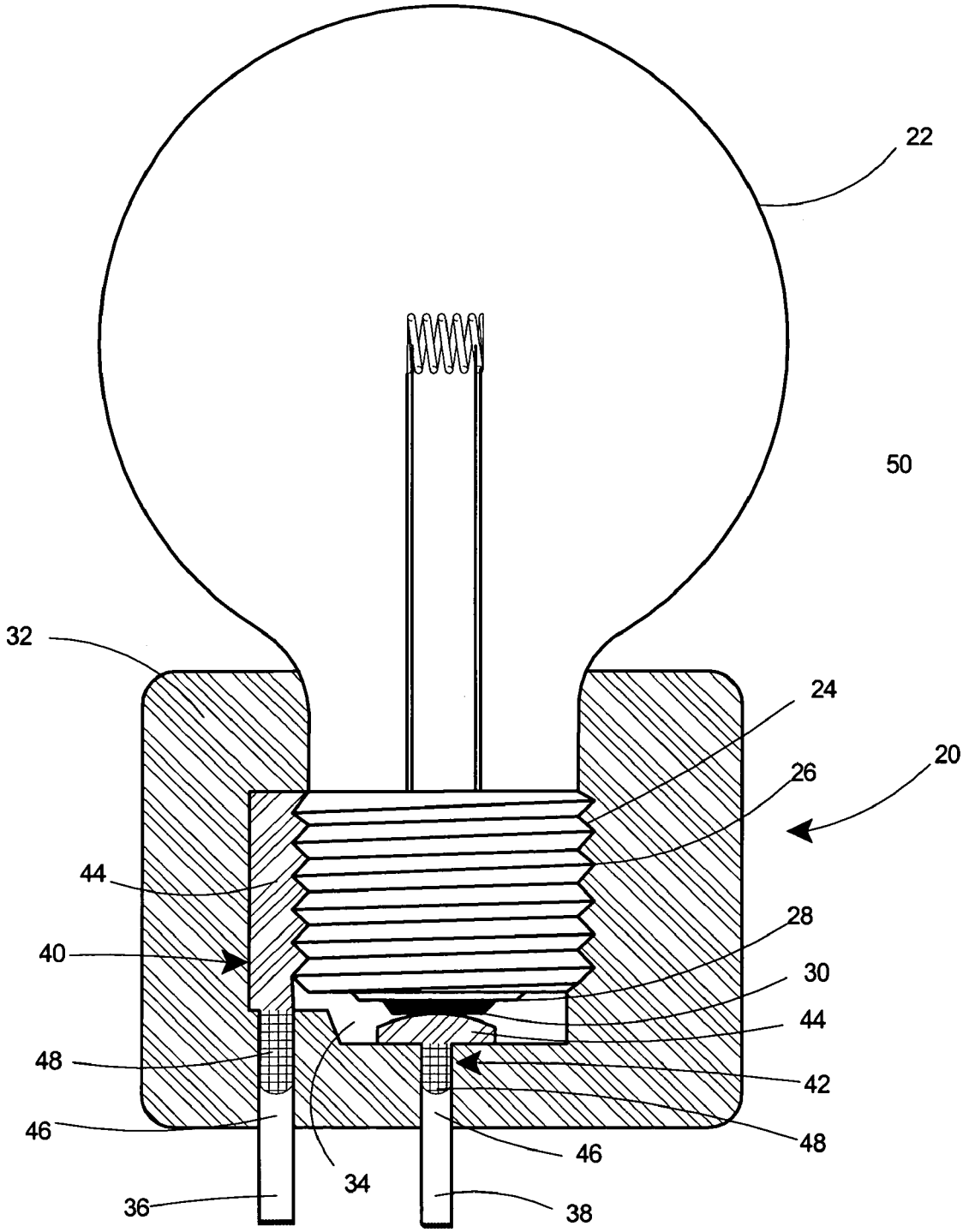
FIG. 1 is a sectional view of a lamp holder according to the present invention for use with an incandescent light with a threaded base.

The following is a listing of part numbers used in the drawings along with a brief description:

| Part Number | Description |
|---|---|
| 20 | lamp holder |
| 22 | lamp or bulb |
| 24 | threaded base of bulb |
| 26 | electrically conductive side portion or threads of bulb |
| 28 | insulating material of bulb |
| 30 | electrically conductive stem of bulb |
| 32 | lamp housing |
| 34 | lamp receiving portion |
| 36 | positive contact |
| 38 | negative contact |
| 40 | first electrically conductive pathway |
| 42 | second electrically conductive pathway |
| 44 | electrically conductive elastomeric portion |
| 46 | electrically conductive metallic portion |
| 48 | overlap area |
| 50 | glass envelope |
| 52 | lamp holder (alternate embodiment) |
| 54 | floodlight |
| 56 | protective lip |
| 58 | outer periphery of lamp |
| 60 | lamp holder (alternate embodiment) |
| 62 | floodlight |
| 64 | lighting fixture with a tubular lamp receiver |
| 66 | elastomeric ring |
| 68 | outer surface of ring |
| 70 | tubular receiver |
| 72 | inner diameter of tubular receiver |
| 74 | axial center of tubular receiver |
| 76 | lamp holder (alternate embodiment) |
| 78 | floodlight |
| 80 | lamp holder (alternate embodiment) |
| 82 | fluorescent lamp |
| 84 | bracket |
| 86 | first contact |
| 88 | second contact |
| 90 | lamp holder (alternate embodiment) |
| 92 | socket joint |
| 96 | ball |
| 98 | first electrically conductive portion on lamp housing |
| 100 | second electrically conductive portion on lamp housing |
| 102 | first electrically conductive portion on socket |
| 104 | second electrically conductive portion on socket |
| 106 | socket |
| 108 | lamp holder (alternate embodiment) |

DETAILED DESCRIPTION

The present invention comprises a lamp holder, of which a preferred embodiment is depicted in FIG. 1. A sectional view of a preferred embodiment of the lamp holder 20 is depicted in FIG. 1 along with an inserted incandescent light bulb or lamp 22 having a threaded base 24. The threaded base 24 of the lamp 22 includes an electrically conductive side portion 26 separated by an insulating material 28 and an electrically conductive stem 30. The lamp holder 20 includes a lamp housing 32, a lamp receiving portion 34, and external electrical contacts including a positive 36 and negative 38 electrical contact. The lamp receiving portion 34 in the lamp holder 20 depicted in FIG. 1 is a threaded socket to receive the bulb 22 with the threaded base 24. The lamp housing 32 includes a first electrically conductive pathway 40 leading from the lamp receiving portion 34 to the positive electrical contact 36. The lamp housing 32 also includes a second electrically conductive pathway 42 leading from the lamp receiving portion 34 to the negative electrical contact 38. The lamp housing 32 is formed of an electrically non-conductive or electrically insulating elastomer. The first electrically conductive pathway 40 includes an electrically conductive elastomeric portion 44 and an electrically conductive metallic portion 46. There is an overlap area 48 in which the electrically conductive elastomeric portion 44 and the electrically conductive metallic portion 46 overlap and are bonded to each other. As the lamp housing 32 is formed of electrically non-conductive material, the first 40 and second 42 electrically conductive pathways are disposed within the lamp housing 32 and are therefore electrically isolated from one another. The combined elastomeric and metallic portion can extend all the way from the lamp receiving portion 34 to the contacts 36 and 38. However, it is most preferred that the portion of the first 40 and second 42 electrically conductive pathways immediately adjacent the lamp receiving portion 34 be entirely elastomeric. This insures that there will be no metal to metal contact, and therefore no vibration or shock transmission, between the lamp housing 32 and the light bulb 22. The absence of metal to metal contact also imparts corrosion resistance to the lamp holder, thereby allowing it to avoid metal fusion effect or "lock up" caused by environmental corrosion. Lock up refers to the bonding of separate pieces of metal, which are in contact and fused together by the effects of corrosion.

Since the lamp housing 32 and the conductive pathways 40, 42 are all formed of elastomeric materials; they act to provide shock and vibration resistance to the inserted light bulb 22. The preferred material of construction of the elastomeric lamp housing 32 is electrically non-conductive silicone. The preferred material of construction of the electrically conductive elastomeric portion 44 of the conductive pathways 40, 42 is electrically conductive silicone. As shown in FIG. 1, the bulb 22 and its threaded base 24 are completely surrounded by the electrically non-conductive elastomeric lamp housing 32 and the electrically conductive elastomeric portion 44. There is no direct metal to metal contact between the metallic threaded base 24 and the metallic portion 46 of the electrically conductive pathways 40, 42. Conventional prior art lamp housings are typically constructed of rigid plastic or ceramic material. Both rigid plastic and ceramics are very conducive to transmitting vibrations and shocks to the attached bulb. Continual vibration over time or shocks can cause failure of the bulb in several ways, including causing the bulb to become loose and back out of the socket, causing the glass envelope of the bulb to break, or causing the fragile filament to break. In an environment subjected to continual vibration, it is not common for light bulbs to become separated from their electrical contacts.

In the novel lamp holder of the present invention, all portions of the lamp holder 20 including the conductive pathways 40, 42 and the lamp housing 32, are constructed of elastomeric materials. Therefore there is a significant dampening effect on vibrations or shocks applied or transmitted to the exterior of the lamp housing 32. The vibrations and shocks are significantly attenuated, and very little is transmitted to the light bulb. In addition, the lamp housing 32 is preferably constructed of silicone rubber having a Shore Hardness in the range of 50 to 90. The surface of silicone rubber has a very high coefficient of friction which, in the case of the lamp holder 20 of FIG. 1, enables the surface of the lamp receiving portion 34 to exert a great deal of surface friction to prevent the bulb 22 and the threaded base 24 from backing out of the lamp holder 20.

Another advantage of the present invention is that the light bulb 22 can be made waterproof. As shown in FIG. 1, the lamp housing 32 can be molded to extend beyond the juncture of the threaded base 24 and glass envelope 50 of the light bulb 22. As a consequence of the resiliency of the elastomeric materials of construction of the lamp housing 32, the light bulb 22, when pushed or threaded into the lamp receiving portion or socket 34, is sealed by the elastomeric lamp housing 32. The lamp receiving portion 34 of the lamp housing 32 can be formed with threads to accept the threaded base 24 or can be formed with smooth walls. Since the lamp housing 32 is formed of elastomeric materials, the bulb 22 can be pushed in against the smooth walls of the lamp receiving portion 34 or advanced axially against the threaded lamp receiving portion 34.

Figure 2:
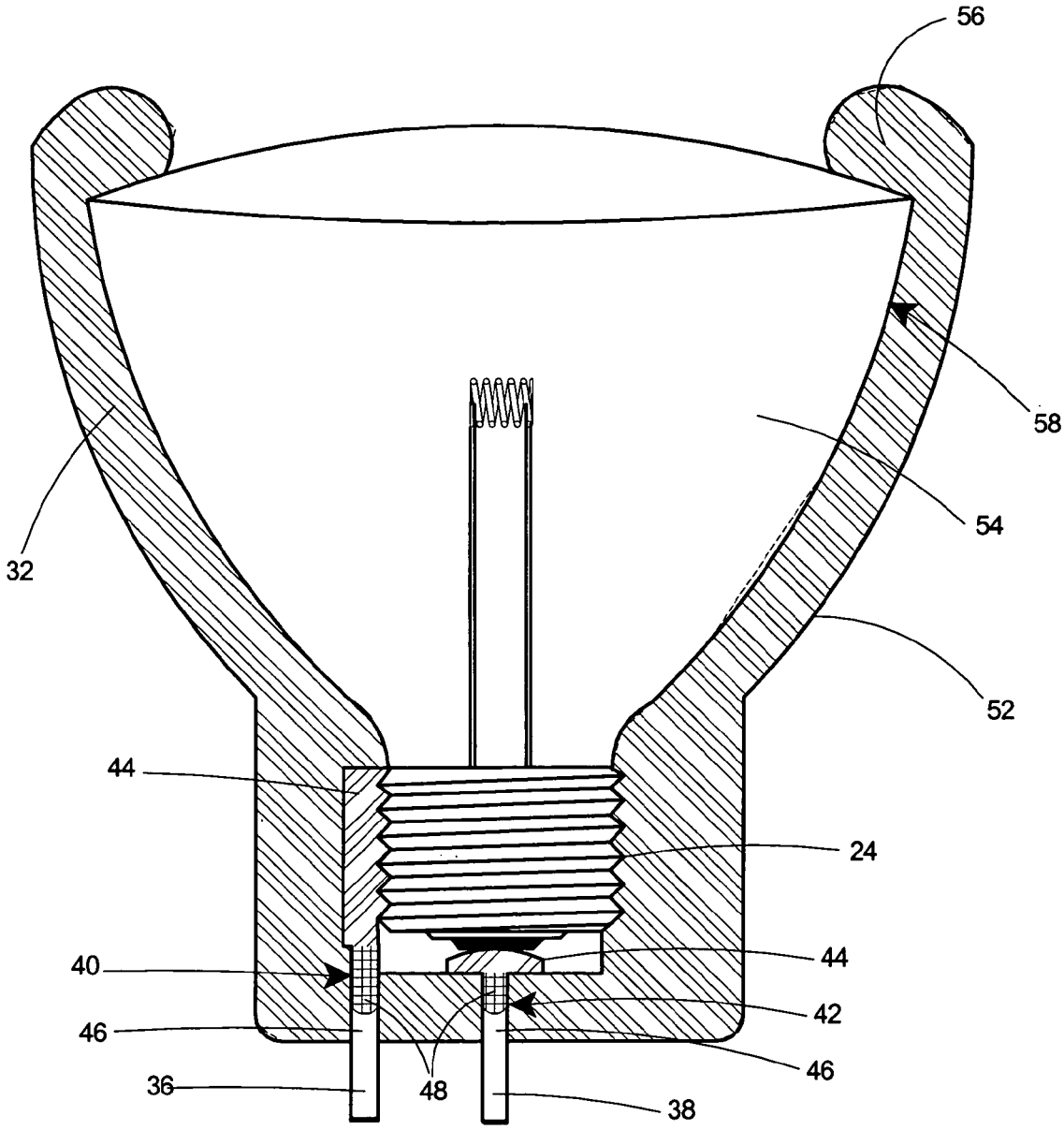
FIG. 2 is a sectional view of an alternate embodiment of a lamp holder according to the present invention for use with a floodlight with a threaded base.

Referring to FIG. 2, there is depicted an alternate embodiment of a lamp holder 52 according to the present invention for use with a floodlight 54 with a threaded base 24. As in the preferred embodiment, the lamp housing 32 is formed of electrically non-conductive elastomer and the conductive pathways 40, 42 are constructed of elastomer and metal. A protective lip 56 can be molded as an integral portion of the lamp housing 32. The protective lip 56 will extend 3600 around the outer periphery 58 of the lamp 22 and thereby protect and seal it against rain, water, bugs, or other contaminants or environmental conditions. The preferred material of construction of the lamp housing 32 is electrically non-conductive silicone, which is heat resistant and will enable the lamp housing to retain its resiliency after long term exposure to the heat of the light bulb 22.

Figure 3:
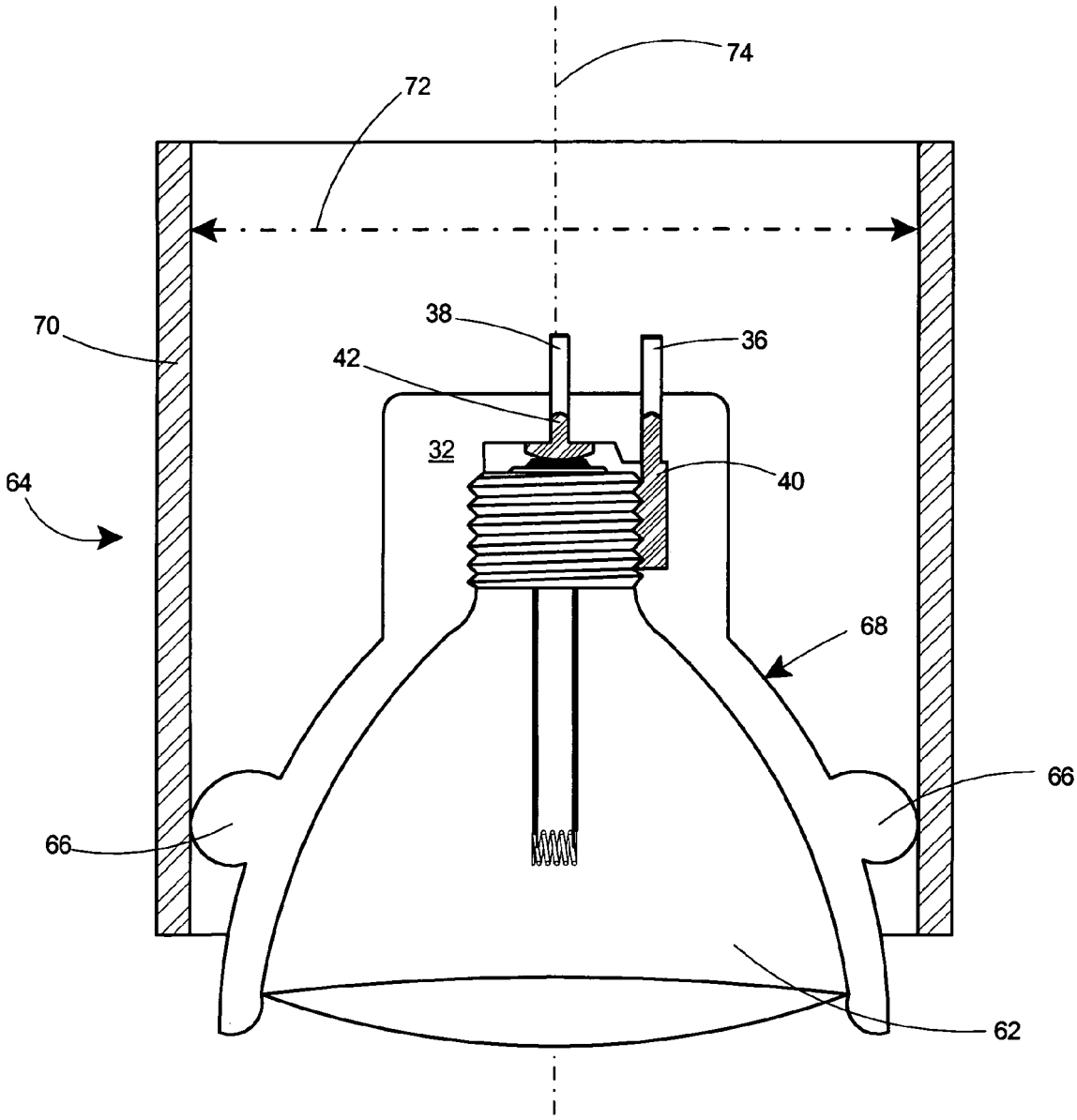
FIG. 3 is a sectional view of an alternate embodiment of a lamp holder according to the present invention for a floodlight used in a lighting fixture with a tubular lamp receiver.

With reference to FIG. 3, there is depicted another alternate embodiment of a lamp holder 60 according to the present invention for use with a floodlight 62 used in a lighting fixture with a tubular lamp receiver 64. The lamp housing 32 includes an integral elastomeric ring 66 on its outer surface 68. The lamp housing 32 is used in conjunction with a tubular receiver 70, a portion of which is shown in FIG. 3. The outer dimension of the lamp housing 32 measured across the integral ring 66 is greater than the inner diameter 72 of the tubular receiver 70 and therefore, pressing the lamp housing 32 into the tubular receiver 70 causes the integral ring 66, which extends 360° around the periphery of the lamp housing 32, to compress against the walls of the tubular receiver 70. The elastomeric ring 66 has a high coefficient of friction and therefore holds the lamp within the tubular receiver 70. The lamp housing 32 can be twisted and turned within the tubular receiver 70 to orient the lamp 22 to various desired axes with respect to the axial center 74 of the tubular receiver 70 to orient the beam of light to the desired orientation.

Figure 4:
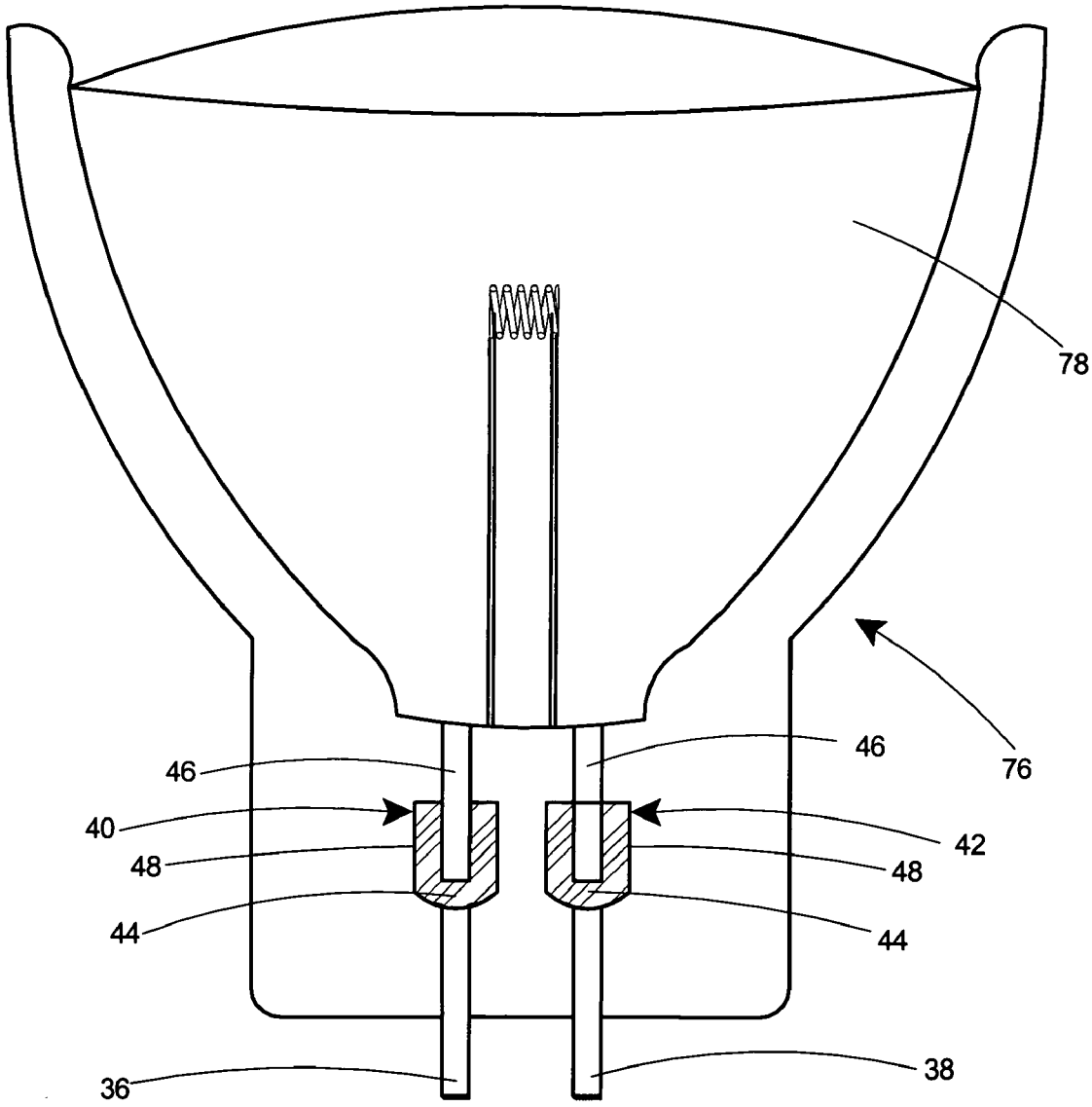
FIG. 4 is a sectional view of an alternate embodiment lamp holder according to the present invention for use with a floodlight having two pin electrical contacts.

Referring to FIG. 4, a further embodiment is shown of a lamp holder 76 according to the present invention. This embodiment of the lamp holder 76 is for use with a floodlight 78 having two pin electrical contacts, sometimes referred to as a bi-pin bulb. The lamp housing 32 is formed of electrically non-conductive elastomer and the electrically conductive pathways 40, 42 include an electrically conductive elastomeric portion 44 and an electrically conductive metallic portion 46.

Figure 6:
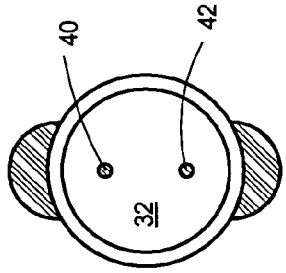
FIG. 6 is an end view of the lamp holder of FIG. 5.
Figure 5:
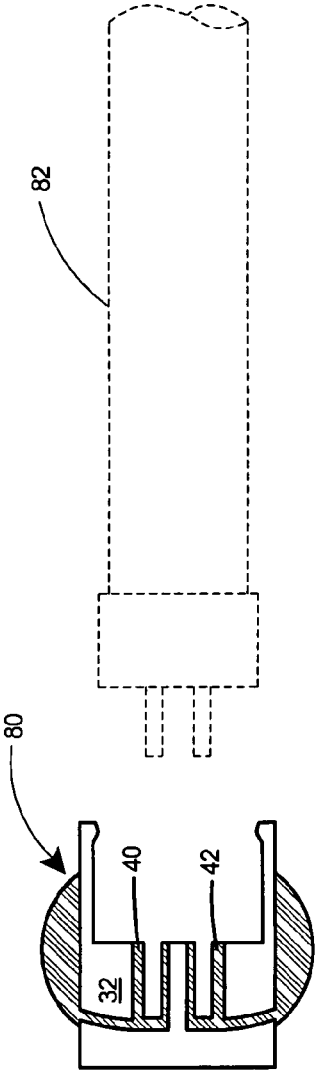
FIG. 5 is a sectional view of an alternate embodiment lamp holder according to the present invention for use with a fluorescent lamp.
Figure 7:
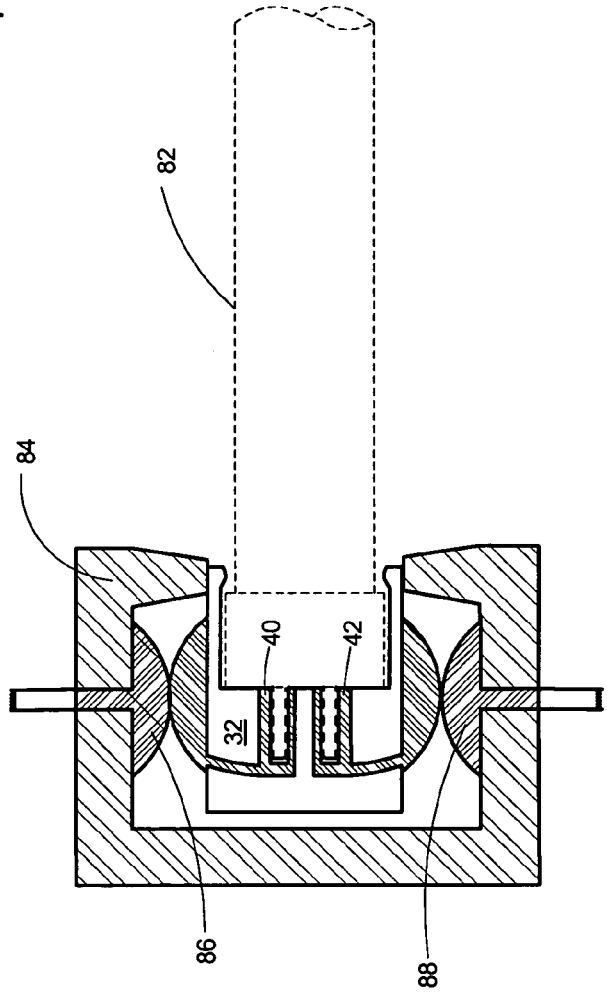
FIG. 7 is a conceptual view of the lamp holder and fluorescent light of FIG. 5 fitted together and placed within a bracket.

With reference to FIGS. 5–7, a further embodiment of a lamp holder 80 is shown according to the present invention for use with a fluorescent lamp 82. The lamp holder includes an electrically non-conductive lamp housing 32 and a first 40 and second 42 electrically conductive pathway. The electrically conductive pathways 40, 42 are preferably constructed of an electrically conductive elastomer. As shown in FIG. 7, the lamp holder 80 can be used with brackets constructed in accordance with the present invention, with an electrically insulating bracket 84 having contacts 86, 88 formed from electrically conductive elastomeric material.

Figure 8:
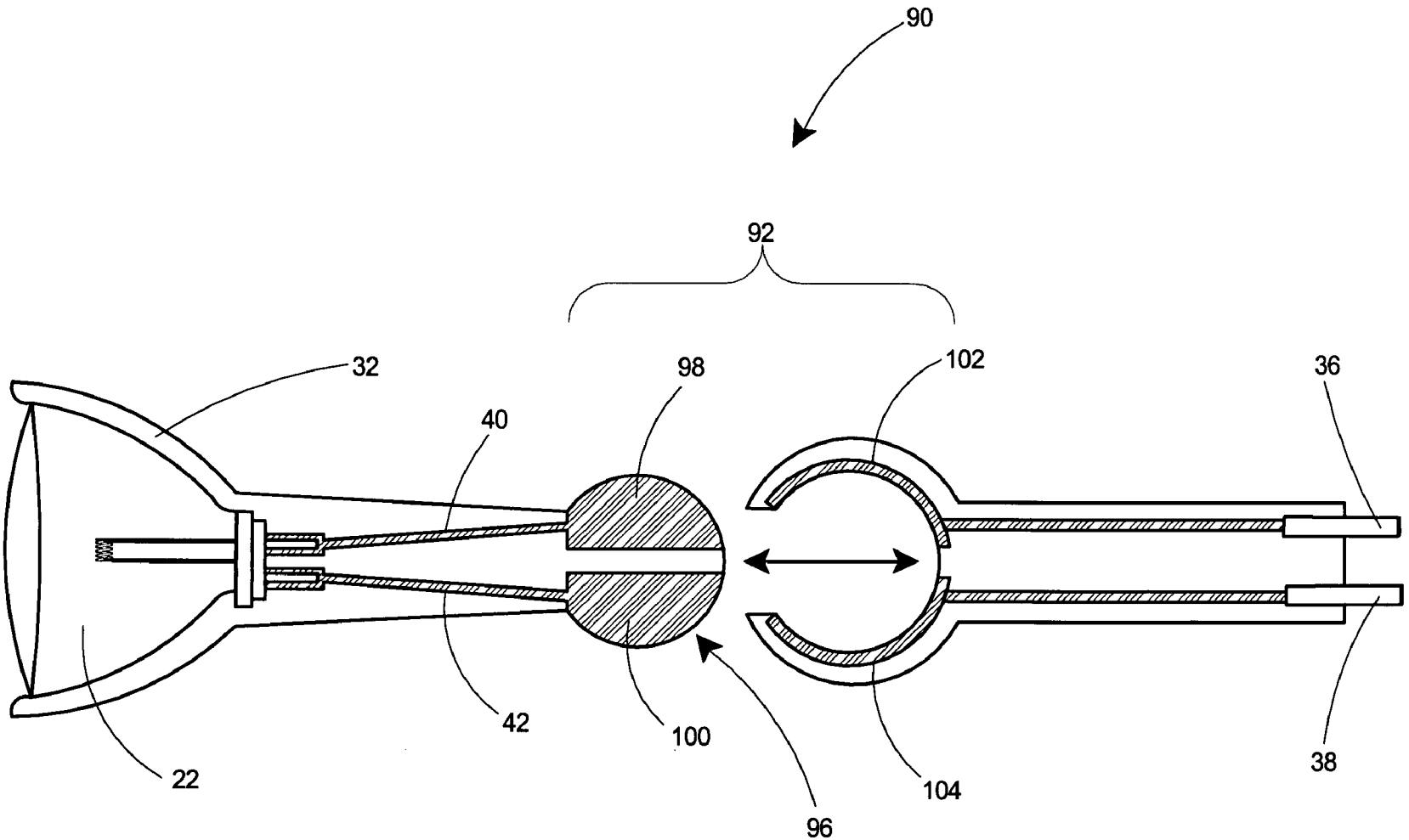
FIG. 8 is a conceptual view of an alternate embodiment of a lamp holder according to the present invention including a socket joint.

With reference to FIG. 8, an alternate embodiment of a lamp holder 90 according to the present invention is shown. The lamp holder 90 includes an electrically non-conductive lamp housing 32 and a first 40 and second 42 electrically conductive pathway. A socket joint 92 is included for electrically connecting the lamp 22 to an electrical source. A ball 96 on the end of the lamp housing 32 includes electrically conductive portions 98, 100 that make contact with electrically conductive portions 102, 104 on a socket 106 that can be connected to an electrical source. The lamp 22 can be rotated with respect to the socket 106 to direct the beam of the lamp to a desired orientation.

Figure 9:
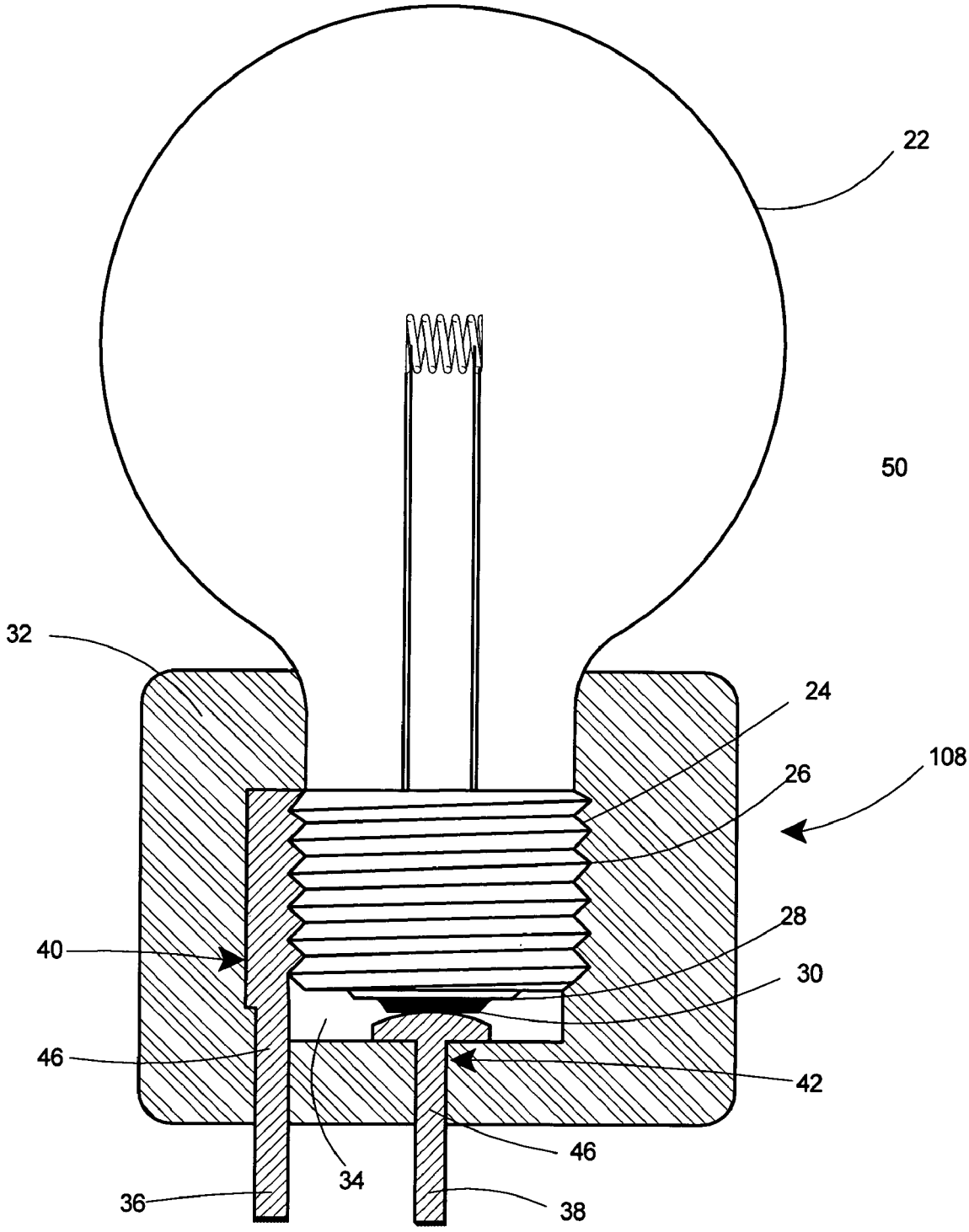
FIG. 9 is a sectional view of an alternate embodiment of a lamp holder according to the present invention having metallic conductive pathways.

Another embodiment of the lamp holder 108, depicted in FIG. 9, is for use with a lamp 22 having a threaded base 24. As in the preferred embodiment, the lamp housing 32 is formed of an electrically non-conductive elastomer. The first 40 and second 42 electrically conductive pathways of lamp holder 108 are constructed entirely of electrically conductive metal 46. The first electrically conductive pathway 40 extending from the electrically conductive side portion 26 of the lamp 22 to the positive contact 36 are formed of metal as is the second electrically conductive pathway 42 extending from the electrically conductive stem 30 of the lamp 22 to the negative contact 38. This embodiment illustrates construction of an impact and corrosion resistant lamp holder 108 having a lamp housing 32 formed of electrically non-conductive elastomer and conductive pathways 40, 42 formed of electrically conductive metal.

The method of forming the various embodiments of the lamp holder of the present invention depicted in FIGS. 1–8 includes providing an electrically conductive metal such as copper, silver, gold or the like for the metallic portion of the electrically conductive pathways. A metal strip is laid in a mold and the mold is then filled with an uncured electrically conductive silicone composition. Typical conventional uncured electrically conductive silicone compositions are used such as uncured silicone rubber composition including electrically conductive particles such as conductive carbon, silver, gold, or other conductive materials. Heat and pressure are applied for a predetermined amount of curing time to mold the uncured electrically conductive silicone rubber around the electrically conductive metal and thereby form a combined metal and cured silicone electrical conductor. A second mold is provided for a lamp holder according to one of the embodiments of the present invention. One or more of the combined metal and silicone rubber electrical conductors, which is now cured electrically conductive silicone rubber as a result of the completed curing cycle of the first mold, is laid in the second mold in the appropriate location to form one or more electrically conductive pathways. The second mold is then filled with a conventional uncured electrically non-conductive silicone, which consists of uncured silicone rubber without any added conductive particles. A curing cycle including heat and pressure is applied to the second mold to cure the uncured electrically non-conductive silicone rubber and simultaneously bond the combined metal and silicone rubber electrical conductors to the electrically non-conductive silicone rubber. As applied to the lamp holder of FIG. 1, the result of the two-step molding process is an electrically non-conductive lamp housing 32 having one or more electrically conductive pathways 40 and 42 permanently bonded therein.

The lamp holder 108 of FIG. 9, having metallic electrically conductive pathways 40, 42, can be formed by placing one or more metal conductors in a mold, placing an uncured, electrically non-conductive silicone rubber composition in the mold, and heating the mold under conditions of heat and pressure to cure the electrically non-conductive silicone rubber composition and bond it to the metal conductors.

The lamp holder of the present invention may be formed with a lamp receiving portion that will accommodate an electrical light having a threaded base, metal pins or prongs, or having a bayonet-type electrical connector.

As the invention has been described, it will be apparent to those skilled in the art that the same may be varied in many ways without departing from the spirit and scope of the invention. Any and all such modifications are intended to included within the scope of the appended claims.

What is claimed is:

1. An integral one-piece lamp holder comprising:

a lamp housing formed of electrically non-conductive elastomer;

said lamp housing including a lamp receiving portion and external electrical contacts;

a first electrically conductive pathway leading from said lamp receiving portion to a first of said electrical contacts;

a second electrically conductive pathway leading from said lamp receiving portion to a second of said electrical contacts;

said first and said second electrically conductive pathways formed of electrically conductive elastomer and electrically conductive metal permanently bonded together by heat and pressure in a first molding operation; and said lamp housing and said first and said second electrically conductive pathways permanently bonded together by heat and pressure in a second molding operation to form said lamp holder, wherein said lamp receiving portion forms a socket for completely enclosing the base of a lamp therein and said lamp receiving portion constructed of elastomers eliminates any metal to metal contact between said lamp receiving portion and said base of said lamp inserted therein.

2. The lamp holder of claim 1 wherein said first and second electrically conductive pathways include an elastomeric portion adjacent said lamp receiving portion.

3. The lamp holder of claim 2 wherein said first and second electrically conductive pathways include a combined elastomeric and metallic portion between said elastomeric portion and said external electrical contacts, said combined elastomeric and metallic portion bonded together by heat and pressure.

4. The lamp holder of claim 3 wherein said electrically conductive elastomer is electrically conductive silicone rubber.

5. The lamp holder of claim 2 wherein inclusion of said elastomeric portion adjacent said lamp receiving portion ensures that there is no metal to metal contact between said electrical pathways and a lamp inserted in said lamp receiving portion.

6. The lamp holder of claim 1 wherein said lamp receiving portion is an electrical light socket.

* * * * *